US005933067A

United States Patent [19]

Frolov

[11] Patent Number: 5,933,067

[45] Date of Patent: Aug. 3, 1999

[54] UNIVERSAL SOLENOID ACTUATOR

[75] Inventor: George Frolov, Farmington, Conn.

[73] Assignee: Harrow Products, Inc., Grand Rapids, Mich.

[21] Appl. No.: 09/093,013

[22] Filed: Jun. 5, 1998

Related U.S. Application Data

[60] Provisional application No. 60/049,254, Jun. 10, 1997.

[51] Int. Cl.[6] ..... H01F 3/00

[52] U.S. Cl. ..... 335/251; 335/253; 335/256; 335/257; 335/260

[58] Field of Search ..... 335/251, 255, 335/253, 256, 260, 266, 273

[56] References Cited

U.S. PATENT DOCUMENTS

| | | | |
|---|---|---|---|
| 3,895,331 | 7/1975 | Saarem | 335/253 |
| 4,494,096 | 1/1985 | Fuzzell | 335/170 |
| 4,496,921 | 1/1985 | Carrera | 335/258 |
| 4,651,118 | 3/1987 | Zeuner et al. | 335/258 |
| 4,683,454 | 7/1987 | Vollmer et al. | 335/299 |
| 4,736,177 | 4/1988 | Vollmer et al. | 335/299 |
| 5,027,929 | 7/1991 | Ratke et al. | 192/4 A |

*Primary Examiner*—Michael L. Gellner
*Assistant Examiner*—Tuyen T. Nguyen
*Attorney, Agent, or Firm*—Alix, Yale & Ristas, LLP

[57] ABSTRACT

A universal solenoid actuator for use with either a fail-safe or a fail-secure lock mechanism or a push-type or pull-type mechanism comprises a reversible coil assembly, at least one plunger and a module for receiving electricity from a power supply and delivering the electricity to the coil assembly. The coil assembly includes a housing which defines a bore extending through the coil assembly, at least one coil surrounding the bore and first and second fittings at opposed ends of the bore. The plunger is received within the bore and is actuated upon application of an electrical potential to the coil assembly. When used with a fail-safe lock, the first fitting is affixed to the lock. When used with a fail-secure lock, the coil assembly is reversed to affix the second fitting to the lock. Variations of the preferred embodiment of the inventive universal solenoid actuator are disclosed.

13 Claims, 2 Drawing Sheets

UNIVERSAL SOLENOID ACTUATOR

CROSS-REFERENCE TO RELATED APPLICATION

This application claims priority of Provisional Application 60/049,254 filed Jun. 10, 1997.

BACKGROUND OF THE INVENTION

1. Field of the Invention

The present invention generally relates to electrically actuated lock mechanisms, including electric strikes. More particularly, the present invention relates to solenoid assemblies and coil assemblies therefor for use in such lock mechanisms. Accordingly, the general objects of the present invention are to provide novel and improved methods and apparatus of such character.

2. Description of the Related Art

In high security areas such as banks, computer rooms, museums, etc., electrically actuated strikes and door locks are frequently employed. These devices can be of either the fail-secure or fail-safe type. In fail-safe electric strikes and door locks, a locking condition is attained upon energizing the electric lock mechanism and an unlocking condition is attained by deenergizing the electric mechanism. Thus, a power failure or the like results in an unlocked condition of the mechanism, i.e., fail-safe. Conversely, in fail-secure electric strikes and door locks, a locking condition is attained upon deenergizing the electric mechanism and an unlocking condition is attained by energizing the electric mechanism. Thus, a power failure or the like results in a locked condition of the mechanism, i.e., fail-secure.

In order to provide electrical actuation of the lock mechanism in both fail-safe and fail-secure locks, a solenoid actuator is electrically connected to a switched source of electricity, such as from a power supply and a control system, and is physically connected to a latch mechanism of the lock. The solenoid actuator includes a coil assembly and an associated plunger which is driven by the coil and which actuates the latch mechanism of the strike or lock. Selective application of electricity to the solenoid, thus, causes energization/deenergization of the solenoid actuator which, in turn, produces the desired functionality.

While the preferred application of the invention is for use in conjunction with electric strikes, examples of fail-safe and fail-secure locks employing a solenoid actuator of the type described above may be found in U.S. Pat. Nos., 4,557,121 and 4,579,376, both of which have been assigned to the assignee of the present invention. The contents of both of these patents are hereby incorporated by reference. While the locks shown therein offer superb functionality, those of ordinary skill will recognize that solenoids utilized with the fail-safe locks shown therein are of a different construction than those utilized with the fail-secure locks shown therein. Thus, the manufacture of these locks entails the manufacture of both types of solenoids. Naturally, this results in a substantial amount of duplicated effort and a concomitant increase in the cost of both types of locks for many reasons. It would, therefore, be desirable to provide a single solenoid actuator which is compatible with either type of lock or function.

Accordingly, there remains a need in the art for a solenoid actuator which overcomes the aforementioned deficiencies of the related art by offering compatibility with either fail-safe (push-type) or fail-secure (pull-type) lock mechanisms or actuators.

Additionally, there remains a need in the art for a solenoid actuator which overcomes the aforementioned deficiencies of the related art by providing a solenoid actuator which can be converted between a solenoid actuator for use with a fail-safe mechanism and a solenoid actuator for use with a fail-secure mechanism with a minimum of effort.

SUMMARY OF THE INVENTION

Briefly stated, the invention in a preferred embodiment is a universal solenoid actuator which is compatible with a conventional power supply and either a fail-safe lock and a fail-secure lock mechanism. The solenoid actuator includes a reversible coil assembly which can be selectively energized/deenergized by selective delivery of electricity from the power supply, at least one movable plunger element for physically actuating the lock mechanism and a module for receiving electricity from the power supply and delivering the electricity to the coil assembly. The coil assembly has first and second fittings which can be affixed to the selected lock mechanism and at least one coil to induce movement of the plunger in response to the delivery of electricity thereto. Either a fail-safe or a fail-secure lock mechanism can be accommodated by reversing the orientation of the coil assembly and the plunger and by affixing one or the other of the fittings to the lock.

In a preferred embodiment, the universal solenoid actuator comprises a reversible coil assembly capable of accommodating either a fail-safe actuator or a fail-secure actuator and module means for receiving electricity from the power supply and delivering the electricity to the coil assembly. The preferred coil assembly includes a housing which defines an internal bore extending through the coil assembly, 12 and 24 volt coils disposed within the housing and about the first and second fittings disposed at opposite ends of the bore.

The first fitting and the portion of the bore which extends therethrough are capable of accommodating the fail-safe actuator. Likewise, the second fitting and the portion of the bore extending therethrough are capable of accommodating the fail-secure actuator. The reversible coil assembly may be affixed to a lock mechanism by physical connection between the lock and either the first fitting or the second fitting. The power supply is connected to either the 12 volt coil or the 24 volt coil depending on the voltage of the particular power supply used. Thus, in the preferred embodiment the selected plunger element functions as either a push-type plunger for a fail-safe lock or a pull-type plunger for a fail-secure lock when the solenoid is energized. The particular function served depends on the orientation of the coil assembly relative to the lock (i.e., which fitting is affixed to the lock mechanism) and the polarity of the electricity delivered to the coils. Alternatively, a single coil can be utilized in place of the 12 and 24 volt coils. Selection of the particular plunger element follows from the selection of the desired function of the solenoid actuator. Accordingly, the preferred solenoid actuator of the present invention can be used either with a fail-safe mechanism or a fail-secure mechanism simply by selecting and installing the desired type of plunger, affixing the coil assembly to the lock at either the first or second fitting as desired and selectively applying electricity to the coil assembly.

In the preferred embodiment of the present invention, the first and second fittings are identical and the solenoid actuator further comprises a connector module. The connector module provides a quick and effective means of delivering electricity to the coil assembly regardless of whether the solenoid actuator is used with a fail-safe or a fail-secure mechanism, such as an electric strike. Because, in this embodiment, the first and second fittings are identical, the connector assembly, which is complementary in shape to both fittings, may be conveniently affixed to either the first or second fittings, whichever is not affixed to the lock mechanism.

In another embodiment of the present invention, the fail-safe and the fail-secure plungers are at least substantially similar to one another. Accordingly, only one actuator need be manufactured and appropriately utilized with the coil assembly to thereby serve as either a fail-safe or a fail-secure actuator.

In still another embodiment of the present invention, a single double-ended plunger is used with a coil assembly having an axial bore and axially opposed first and second fittings. In this embodiment, the double-ended plunger extends through the bore of the coil assembly and outwardly of both the first and second fittings. Energization of the coil assembly drives this plunger in the desired direction as described above and reversal of the coil assembly relative to the lock mechanism yields the option of compatibility with both fail-safe and fail-secure locks. The ends of the plunger maybe either identical or different in structure as desired for compatibility with the particular type of lock with which the solenoid actuator is to be used.

The universal solenoid actuator of the present invention offers significant advantages relative to solenoid assemblies of the related art. First, since the solenoid actuator of the present invention is compatible with both fail-safe and fail-secure lock-type mechanisms, both types of mechanisms can be manufactured more quickly and at a lower cost per unit. Moreover, since one component can serve two purposes with the present invention, the invention also reduces the manufacturer's inventory requirements. These factors also produce a number of other advantageous consequences which reduce the total cost of manufacturing the mechanisms, simplifying the repair thereof, improving the reliability thereof and reducing the inventory cost.

It is accordingly an object of the present invention to provide a universal solenoid actuator which can be quickly and easily assembled for use with either a fail-safe lock or a fail-secure lock at any given time.

It is a further object of the present invention to provide a universal solenoid actuator which is compatible with either fail-safe or fail-secure lock mechanisms at any given time.

It is a further object of the present invention to reduce the cost and time of manufacturing and the expense of inventory of both failsafe and fail-secure lock mechanisms by providing a universal solenoid actuator.

It is yet another object of the present invention to provide a universal solenoid actuator utilizing a coil assembly which is capable of accommodating a plurality of plunger styles to thereby yield a solenoid actuator which may be used with either a fail-safe or a fail-secure lock mechanism at any given time.

Numerous other advantages and features of the present invention will become apparent to those of ordinary skill in the art from the specification and the accompanying drawings.

BRIEF DESCRIPTION OF THE DRAWINGS

The preferred embodiment of the present invention will be described below with reference to the accompanying drawings wherein like numerals represent like structures and wherein.

DESCRIPTION OF THE PREFERRED EMBODIMENT

The preferred embodiment of the universal solenoid actuator of the present invention will be described with joint reference to FIGS. 1 through 3. The latch mechanism depicted in FIGS. 2 and 3 are conventional components of fail-secure and fail-safe mechanisms, respectively, for an electric strike.

Figure 1:
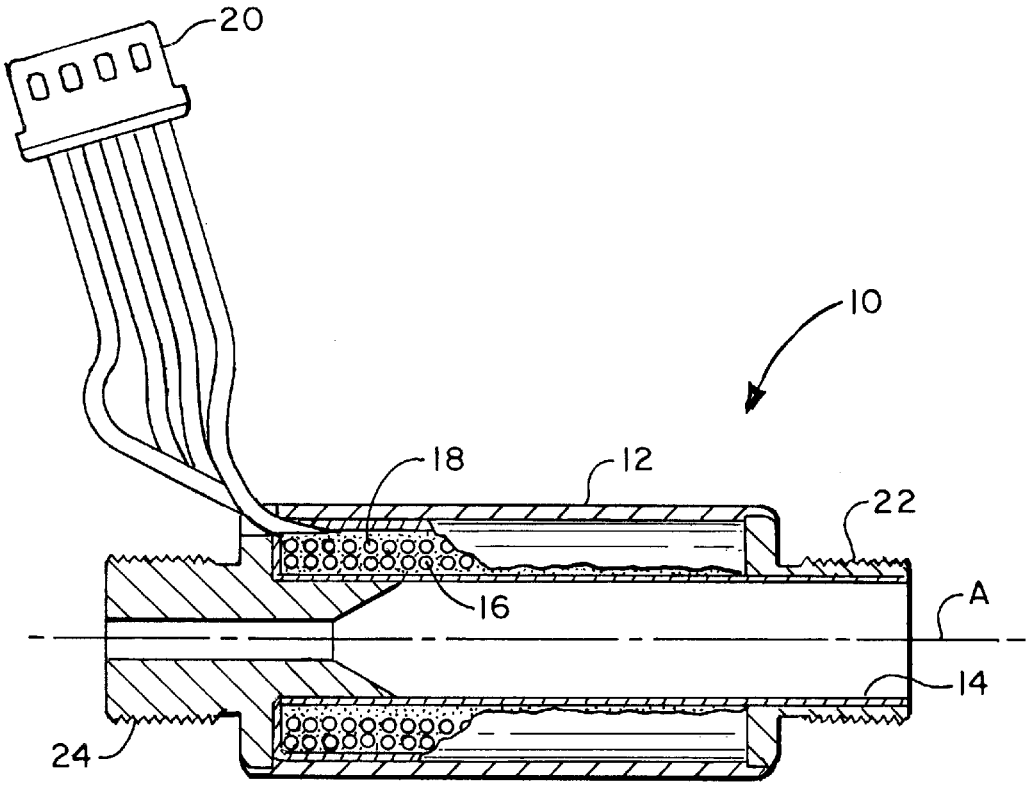
FIG. 1 is a sectional view of a coil assembly in accordance with one embodiment of the present invention.

A coil assembly for use with the preferred solenoid actuator of the present invention is depicted in FIG. 1. As shown, coil assembly 10 includes a housing 12 which defines an axial bore 14 which extends through coil assembly 10 along axis A. Bore 14 is sized and shaped to accommodate either a fail-safe plunger or a fail-secure plunger as will be described in greater detail below. First and second coils 16 and 18 are wound about bore 14 within housing 12. Each of the first and second coils 16 and 18 form a solenoid about axis A. The ends of the first and second coils 16 and 18 terminate at a connector 20 which is connected to either a 12 volt or a 24 volt power supply for selectively applying electricity to the first and second coils 16 and 18 as desired. Alternatively, a single coil could be disposed about bore 14 and the selected plungers could be driven in opposite directions by applying electricity of opposite polarity to the coil. As a further alternative, electricity of the same polarity could be applied to either the first coil 16 or an oppositely wound second coil 18 to drive the plunger within bore 14 in one of two opposite directions.

Coil assembly 10 is terminated at opposite ends thereof by first and second fittings 22 and 24. The peripheral surfaces of the first and second fittings 22 and 24 are preferably identically externally threaded bosses. Axial bore 14 preferably extends through both of the first and second fittings 22 and 24. However, while the portion of bore 14 which extends through first fitting 22 is preferably configured to accept the fail-safe plunger, the portion of bore 14 extending through second fittings 24 is preferably configured to accommodate a fail-secure plunger. The exterior of the first and second fittings 22 and 24 are preferably sized and shaped to be affixed to conventional lock mechanisms by merely threading the coil assembly 10 into the lock mechanism. As will be described below, whichever of the first and second fittings 22 and 24 is not affixed to a lock mechanism can receive a selectively mountable threaded connector module 32 to facilitate delivery of electricity to the coil assembly 10. The first and second fittings 22 and 24 can, alternatively, be configured differently, as necessary, to achieve proper connection between the coil assembly 10 and the lock mechanism. Similarly, a wide variety of connector configurations, such as a bayonet, etc., could be used at the first and second fittings 22 and 24 to affix coil assembly 10 to a lock mechanism, such as the arm of an electric strike.

Figure 2:
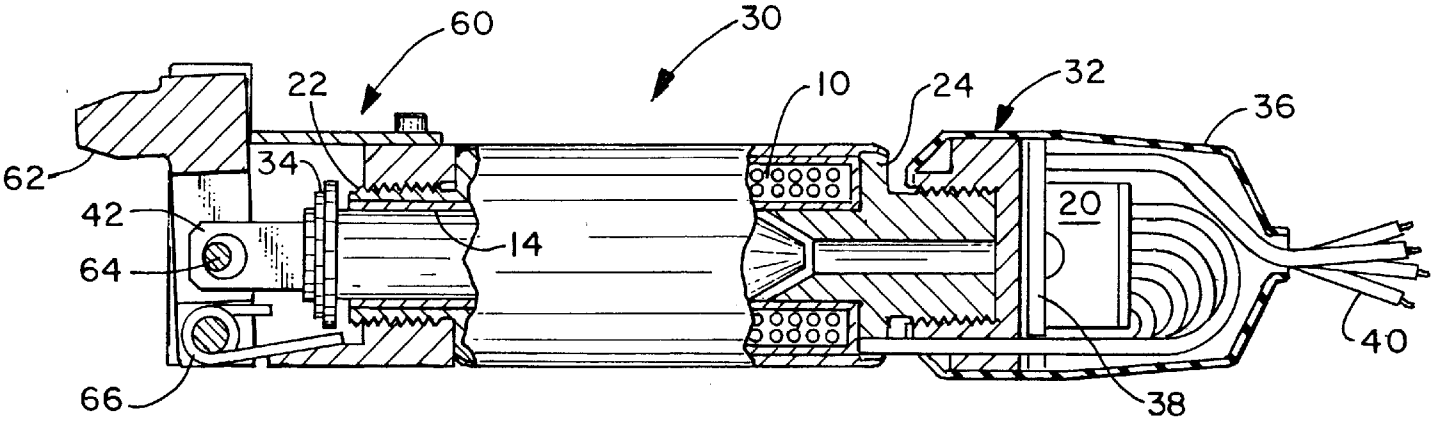
FIG. 2 is a sectional view, partly broken away, of a universal solenoid actuator in accordance with the preferred embodiment of the present invention shown in combination with a latch assembly of a fail-secure or pull-type mechanism.
Figure 3:
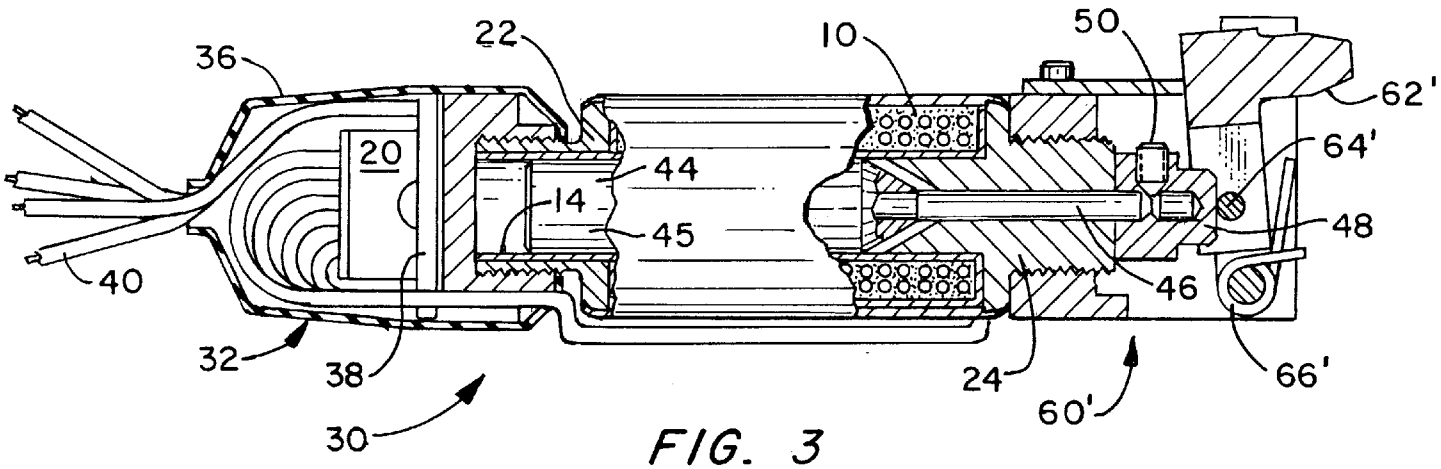
FIG. 3 is a sectional view of the universal solenoid actuator of FIG. 2 shown in combination with a latch assembly of a fail-safe or push-type mechanism.

Turning primarily now to FIG. 2, a solenoid actuator 30 of the preferred embodiment is shown in combination with a latch assembly 60 of a conventional fail-secure lock or pull-type mechanism. As shown in FIG. 2, solenoid actuator 30 includes the coil assembly 10 of FIG. 1, a connector module 32 and a fail-secure plunger 34. Plunger 34 is partially disposed within bore 14 for a movement therein, and the connector module 32 has been threaded onto the second fitting 24. The connector module 32 includes an outer sheath 36 and a circuit board 38 for receiving connector 20 and a plurality of wires 40 connected at the one end thereof to a power supply. Electricity at one of 12 volts or 24 volts is delivered to a circuit board 38 via wires 40 and is appropriately delivered to either the first or second coils 16 and 18 as appropriate via the connection between the circuit board 38 and the connector 20. As shown in FIG. 2, sheath 36 encloses connector 20 and the wires entering and exiting therefrom. Sheath 36 is preferably in the form of a flexible boot.

As shown in FIG. 2, the coil assembly 10 is threaded into a fail-secure or pull-type latch assembly 60 via first fitting 22. Latch assembly 60 includes a lock swing arm 62, a pin 64 and a spring assembly 66. The lock swing arm 62 is connected to a yoke 42 extending from the portion of the fail-secure plunger 34 which extends through the first fitting 22. Movement of the fail-secure plunger 34 and upon energization/deenergization of coil assembly 10 yields corresponding movement of the swing arm 62 to actuate the fail-secure latch assembly 60 for an electric strike. In the case of this embodiment, electricity of an appropriate voltage is selectively supplied to one of the first coil 16 or second coil 18 of coil assembly 10 to cause movement of fail-secure plunger 34.

As shown in FIG. 3, coil assembly 10 can also be reversed and utilized with solenoid actuator 30 to actuate fail-safe or push-type latch assembly 60'. As indicated by the use of like-reference numerals, solenoid actuator 30 of FIG. 3 is substantially similar to solenoid actuator 30 as configured in FIG. 2 with the following primary exceptions. The orientation of coil assembly 10 has been reversed such that fail-safe latch assembly 60' is threaded onto the second fitting 24 and the connector module 32 is threaded onto the first fitting 22. Second, fail-secure plunger 34 of FIG. 2 has been replaced with the fail-safe plunger 44. The fail-safe plunger 44 includes a plunger body 45 from which extends a cam arm 46. The cam end 48 is affixed to the portion of the cam arm 46 which extends outwardly of bore 14 via a set screw 50. The fail-safe plunger 44 cooperates with latch assembly 60' such that displacement thereof actuates swing arm 62'. Finally, the displacement of the fail-safe plunger 44 is induced by the selective application of electricity to coil assembly 10 as noted above.

While the present invention has been described in connection with what is presently considered to be the most practical and preferred embodiments, it is to be understood that the invention is not limited to the disclosed embodiment, but is intended to cover various modifications and equivalent arrangements included within the spirit and scope of the appended claims.

What is claimed is:

1. A universal solenoid actuator for use with a power supply and a mechanism, the mechanism being either a push-type mechanism or a pull-type mechanism, said solenoid actuator comprising:

a reversible coil assembly having a housing which defines a plunger bore extending through said coil assembly, at least one coil disposed within said housing, module means for receiving electricity from the power supply and for delivering the electricity to said coil, and first and second fittings disposed at opposite ends of said bore, said fittings having external connector portions for affixing to the mechanism and one of said first and second fittings being affixed to the mechanism;

at least one plunger element which is partially disposed within said bore for movement therein and which has at least one end thereof extending outwardly of said fitting which is affixed to the mechanism for physical contact with the mechanism, selective delivery of electricity to the module means energizing said coil to generate magnetic forces which move said plunger to actuate the mechanism.

2. The solenoid actuator of claim 1, wherein said solenoid actuator is used with a push-type mechanism;

said coil assembly is connected to the mechanism via physical connection between the mechanism and said first fitting; and said plunger element is a push-type plunger which only has one end thereof extending outwardly of said coil assembly.

3. The solenoid actuator of claim 1, wherein said module means comprises a connector assembly affixed to said second fitting.

4. The solenoid actuator of claim 1, wherein said first and second fittings are exteriorly substantially similar to one another and wherein each of said first and second fittings comprises a boss having an external thread which can be received within either a push-type mechanism or a pull-type mechanism at any given time.

5. A reversible coil assembly for use with a movable plunger, a power supply and a lock mechanism which cooperates with the plunger such that movement of the plunger actuates the lock mechanism, the lock mechanism being either a pull-type lock mechanism or a push-type lock mechanism, said coil assembly comprising:

a housing which defines an internal bore extending through said coil assembly, said bore being configured to at least partially receive the plunger for movement therein;

at least one coil disposed within said housing and wound around said bore to form a solenoid;

a module comprising at least one electrical lead communicating with said coil; and first and second fittings disposed at opposite ends of said bore, both of said first and second fittings having external connectors for affixing to the lock mechanism and one of said first and second fittings being affixed to the lock mechanism such that electricity received from the power supply energizes said coil to thereby induce movement of the plunger, said plunger movement being transmitted through said fitting to the lock mechanism to thereby actuate the lock mechanism.

6. The solenoid actuator of claim 5, wherein said first and second fittings are exteriorly substantially similar to one another and wherein each of said first and second fittings comprises a boss having an external thread which can be received within either a push-type mechanism or a pull-type lock mechanism.

7. The solenoid actuator of claim 5 wherein said module comprises a sheath.

8. The solenoid actuator of claim 5 wherein said module is threadably connectable to said first and second fittings.

9. A universal solenoid actuator for use with a lock mechanism, the lock mechanism being either a fail-safe lock mechanism or a fail-secure lock mechanism, said solenoid actuator comprising:

a reversible coil assembly having an elongated housing which defines a plunger bore extending longitudinally through said coil assembly, at least one coil disposed within said housing, a module electrically connecting with said coil, and first and second fittings disposed at opposite longitudinally spaced ends of said bore, and having substantially identical connectors, one of said first and second fittings being affixed to the lock mechanism;

at least one plunger element which is partially disposed within said bore for longitudinal movement therein and which has at least one end thereof extending outwardly of said fitting which is operatively connected to the lock mechanism, so that selective electricity applied to the module energizes said coil to generate magnetic forces to longitudinally displace said plunger to actuate the lock mechanism.

10. The solenoid actuator of claim 9, wherein said solenoid actuator is used with a fail-safe lock mechanism;

said coil assembly is connected to the lock mechanism via physical connection between the lock mechanism and said first fitting; and said plunger element is a fail-safe plunger which only has one end thereof extending outwardly of said coil assembly.

11. The solenoid actuator of claim 9, wherein said module comprises a connector assembly affixed to said second fitting.

12. The solenoid actuator of claim 10, wherein said first and second fittings are exteriorly substantially similar to one another and wherein each of said first and second fittings comprises a boss having an external thread which can be received within either a fail-safe mechanism or a fail-secure lock mechanism at any given time.

13. The solenoid actuator of claim 11 wherein said module comprises a sheath and is threadably affixed to said second fitting.

* * * * *